US006937212B2

(12) United States Patent
Brewer et al.

(10) Patent No.: US 6,937,212 B2
(45) Date of Patent: Aug. 30, 2005

(54) SYSTEM AND METHOD FOR DRIVING LCD DISPLAYS

(75) Inventors: Donald R. Brewer, Dallas, TX (US); Lee Tak Chun, Hong Kong (HK)

(73) Assignee: Fossil, Inc., Richardson, TX (US)

( * ) Notice: Subject to any disclaimer, the term of this patent is extended or adjusted under 35 U.S.C. 154(b) by 187 days.

(21) Appl. No.: 10/199,611

(22) Filed: Jul. 19, 2002

(65) Prior Publication Data

US 2002/0181335 A1 Dec. 5, 2002

Related U.S. Application Data

(62) Division of application No. 09/847,203, filed on May 1, 2001, now Pat. No. 6,618,327.

(51) Int. Cl.[7] ..... G09G 3/04
(52) U.S. Cl. ..... 345/34; 345/53; 345/94
(58) Field of Search ..... 345/33, 34, 48, 345/51, 53, 87, 94, 95, 204, 208, 89, 55; 368/82, 84, 85, 242

(56) References Cited

U.S. PATENT DOCUMENTS 4,142,361 A * 3/1979 Kimura ..... 368/251
5,726,674 A * 3/1998 Greve ..... 345/94
5,828,488 A * 10/1998 Ouderkirk et al. ..... 359/487
5,874,931 A * 2/1999 Drake et al. ..... 345/51

* cited by examiner

*Primary Examiner*—Regina Liang
(74) *Attorney, Agent, or Firm*—David W. Carstens; Carstens & Cahoon, LLP

(57) ABSTRACT

A system and method for driving a liquid crystal display (LCD) having at least one segment. The system includes an LCD driver connected to a segment of the LCD. A processor is connected to the LCD driver. The processor may be selectively configured into any of at least two multiplexing modes, where the at least two multiplexing modes produce at least three voltage levels for driving the at least one segment of the LCD. Another embodiment includes a system and method for driving an LCD having a segment including a first and second electrode. An LCD driver is coupled to the first and second electrode. A processor is coupled the LCD driver. The processor initiates a substantially periodic signal on the first electrode and a delay signal having a time delay relative to the substantially periodic signal. The signals on the first and second electrodes form an RMS voltage to drive the segment of the LCD to any of at least three display voltage levels.

27 Claims, 13 Drawing Sheets

SYSTEM AND METHOD FOR DRIVING LCD DISPLAYS

This application is a division of U.S. Ser. No. 09/847,203 filed May 1, 2001, now U.S. Pat. No. 6,618,327.

BACKGROUND OF THE PRESENT INVENTION

1. Field of the Invention

The present invention relates generally to LCD displays, and more particularly, but not by way of limitation, to a method and system for driving LCD displays.

2. Description of the Related Art

Liquid crystal displays (LCD) are used extensively in electronic devices and displays. The LCD has become part of every day life, being included in devices have become digital in nature, such as automobile dashboards, computer monitors, radios, and watches.

Traditionally, LCDs have been used to display basic information, such as text, numbers, and symbols, mainly due to the limited capability of the LCD (i.e., on/off; black and white). However, more recently LCDs capable of displaying gray scale and color have become available. Further, technical advances in LCDs have provided the ability to use reflective polarizers within the LCDs to allow for screen printed images and colors to be selectively displayed. One such reflective polarizer is described in Ouderkirk et al., U.S. Pat. No. 5,828,488, and issued Oct. 27, 1998. An application of an LCD utilizing reflective polarizers is described in European Patent EP 0 825 477 A3, published Jun. 23, 1999, and issued to applicant Seiko.

An LCD is a passive device that does not generate light, but rather manipulates the ambient light that passes through it. There are many variations of LCD technology, but the most common of these is the field effect twisted-nematic LCD. To provide the reader with a basic understanding of LCDs and their operation, FIGS. 1 to 3B are provided and discussed hereinafter.

FIG. 1 is a layered representation of an exemplary LCD 100. The LCD 100 includes an upper polarizer 105 coupled to an upper glass layer 110. Beneath the upper glass layer 110 and coupled thereto is an (upper) electrode 115 that is generally transparent. A liquid crystal layer 120 is sandwiched between the upper electrode 115 and a lower electrode 125, which is coupled to a lower glass layer 130. A lower polarizer 135, which may be a reflective polarizer as described in EP 0 825 477 A3, as suggested above, is below the lower glass layer 130. A reflector 140 may also be located below the lower polarizer 135. Although not shown, a screen print may be located between the lower reflective polarizer 135 and the reflector 140. The screen print may show an image or simply reveal a uniform color when a segment is activated or non-activated depending on orientation of polarizers.

FIG. 2 shows selected aspects 200 of the LCD 100 that describe operability of the LCD. A light-molecule or source 205 that is oscillating (i.e., non-polarized) enters the upper polarizer 105. Because the upper polarizer 105 is polarized in a single plane, only light 210 having its direction vector in the same plane as the upper polarizer 105 passes through the upper polarizer 105, which generally results in a 50% decrease in light intensity.

Two states of the LCD are shown, (i) voltage applied and (ii) voltage not applied. In the first case, (i.e., voltage not applied), the light 215*a* is rotated in polarity by 90 degrees after passing through the liquid crystal 120. By not applying a voltage, or applying a voltage below a "turn-on" threshold, to the electrodes 115 and 125, the crystalline structure 120*a* of the liquid crystal 120 is twisted or rotated by 90 degrees. This 90 degree rotation causes the polarization of the light to be aligned with the lower polarizer 135 such that the light 215*a* passes through the lower polarizer 135. This light 215*a* is reflected off of the reflector 140 and a gray-on-gray image is displayed on the LCD as viewed through the upper polarizer 105. LCDs having a 90 degree twist of the liquid crystal, which are organic molecules, are, generally, twisted nematic (TN) liquid crystals. More recently, super twisted nematic (STN) liquid crystals provide for as much as 360 degrees of twist. The STN liquid crystals provide a much higher response to an applied voltage, thereby allowing for many more segments to be integrated in a display while still producing a high contrast display.

In the second case (i.e., voltage applied), the crystalline structure 120*b* of the liquid crystal 120 becomes aligned in the same direction (i.e., perpendicular to the electrodes 115 and 125) such that the light 215*b* is not twisted upon exiting the liquid crystal 120. Because the lower polarizer 135 is oriented perpendicular to the polarization of the incoming light 215*b*, the incoming light is blocked or absorbed by the lower polarizer 135 and is not reflected by the reflector 140. The image is seen on the LCD as being a "positive" image (i.e., black on gray) as viewed through the upper polarizer 105.

FIGS. 3A and 3B are exemplary LCDs 300*a* and 300*b* having seven segments for displaying a digit. In FIG. 3A, upper electrodes 115*a*–115*g* are each applied a voltage so that the digit "8" is displayed. In FIG. 3B, upper electrodes 115*d*–115*f* are each applied a voltage so that the digit "7" is displayed. The lower electrode 125 is considered to be a "common" so that a voltage differential is created between the segments connected to the upper electrodes 115*a*–115*g* having voltage applied thereto. It should be understood that the liquid crystal substantially sandwiched (i.e., within a segment, which is defined by common borders of the upper and lower electrodes 115 and 125) are affected by the root-mean-square (RMS) voltage applied to the electrodes 115 and 125.

Driving systems for LCDs generally include specialized circuitry that have standardized functionality. Two conventional approaches using digital circuitry have been taken by designers of driving systems for LCDs; a first approach is a fixed multiplexing approach, and a second approach is a pulse width modulation (PWM) multiplexing approach.

The fixed multiplexing approach operates on the basis of having a fixed number of lower electrodes or backplanes 125 connected to a driving system, where the driving system is configured to drive the upper and lower electrodes with predetermined voltages based on the number of backplanes to turn on and off the segments of the LCDs. A duty cycle is generated by the driving system to create an RMS voltage based on the fixed number of backplanes of the LCD. A limitation of the fixed multiplexing approach is that only two levels can be created on the LCD because the RMS voltage levels produced by the LCD driving system are fixed (i.e., on or off). Once a particular driving system (e.g., driver chip) and the number of backplanes of the LCD are selected or specified, a manufacturer of LCDs selects a liquid crystal fluid that operates within the range of the driving system. Those skilled in the art appreciate that a non-direct current (non-DC) voltage is generated by the driving system and applied to the LCD to avoid damaging the LCD.

Designers who desire gray-scale or color blends (i.e., voltage level changes) displayed on the LCD use pulse width modulation multiplexing. The pulse width modulation multiplexing approach operates on the basis of being able to drive an upper and lower electrode pair using pulse width modulation. One commercially available LCD driving system, SED1767, using conventional PWM is provided by S-MOS Systems, a Seiko Epson affiliate. This LCD driving system provides up to 16 gray-scale levels. However, this driving system requires many inputs, including gray-scale data bits to set gray-scale levels or duty cycles by the LCD driving system.

In general, the LCD driving systems used to generate various gray-scale voltage levels using conventional PWM to produce multi-level displays on LCDs are rather complex and expensive due to their unique functionality. Essentially, these specialty LCD driving systems have been developed for high-end commercial systems. Thus, consumer goods, such as watches, that are sufficiently driven by market considerations, such as price, are cost-prohibited from using LCD driving systems using conventional PWM multiplexing to generate multi-level displays (e.g., gray-scale and color) on LCDs. And, LCD driving systems operated using a fixed multiplexing approach, while inexpensive, cannot produce more than two levels on the LDC.

SUMMARY OF THE INVENTION

To overcome the problems of having to use LCD driving systems using conventional PWM multiplexing that are expensive and complex to create multi-level displays on LCDs, at least two inexpensive and relatively simple approaches are provided by the principles of the present invention. One approach (approach A) utilizes selectable or variable multiplexing, and another approach (approach B) utilizes delay signal multiplexing.

One embodiment of approach A includes a system and method for driving a liquid crystal display (LCD), having at least one segment. The system includes an LCD driver connected to at least one segment of the LCD. A processor is connected to the LCD driver. The processor may be selectively configured into any of at least two multiplexing modes, where the configured multiplexing mode initiates a signal having at least three different voltage levels for driving the at least one segment of the LCD. An external selector may be connected to the processor, where the external selector may selectively instruct the processor to achieve a particular voltage level. An internal selector may alternatively selectively configure the processor.

One embodiment of approach B includes a system and method for driving a liquid crystal display (LCD) having at least one segment including a first and second electrode. An LCD driver is coupled to the first and second electrode. A processor is coupled to the LCD driver. The processor initiates a substantially periodic signal on the first electrode and a delay signal having a time delay relative to the substantially periodic signal. The signals on the first and second electrodes form an RMS voltage to drive the segment of the LCD to any of at least three display levels. An external selector may be connected to the processor, where the external selector selectively configures the processor for selectively changing the time delay of the delay signal.

Each of the approaches may be utilized within a larger system, including a clock, a watch, a garment, a component of a garment, jewelry, and a display.

A more complete appreciation of the present invention and the scope thereof can be obtained from the accompanying drawings, which are briefly summarized below, the following detailed description of the presently-preferred embodiments of the invention, and the appended claims.

DETAILED DESCRIPTION OF THE DRAWINGS

Figure 1:
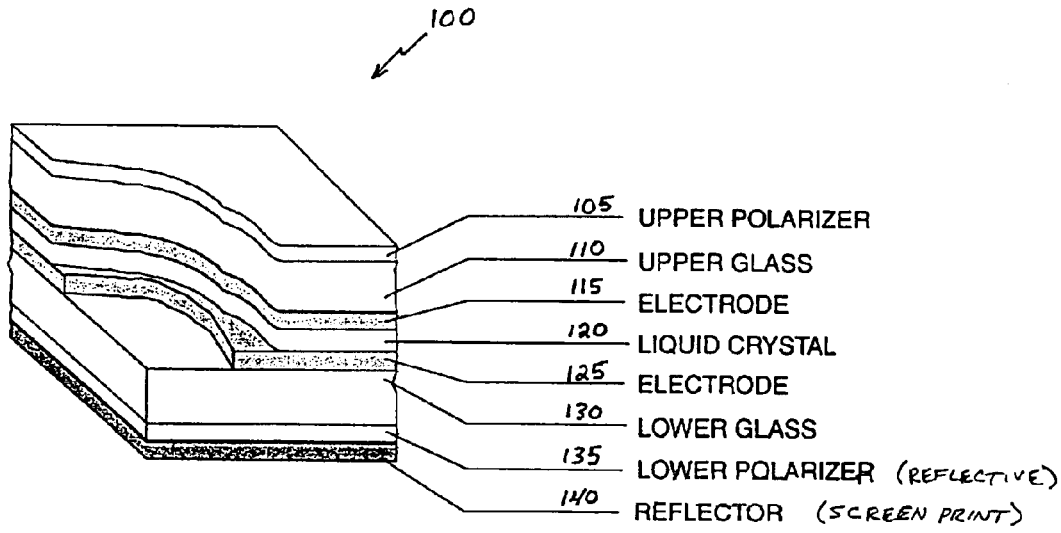
FIG. 1 (PRIOR ART)
FIG. 1 is an exemplary portion of an LCD showing layers that compose the LCD.
Figure 2:
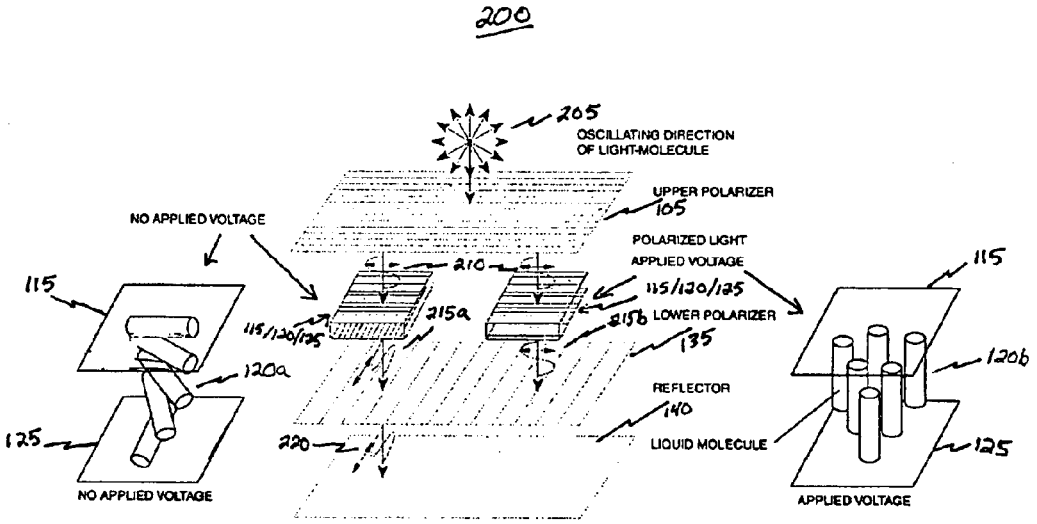
FIG. 2 (PRIOR ART)
FIG. 2 is a representative schematic diagram of the LCD in operation according to FIG. 1.
Figure 3B:
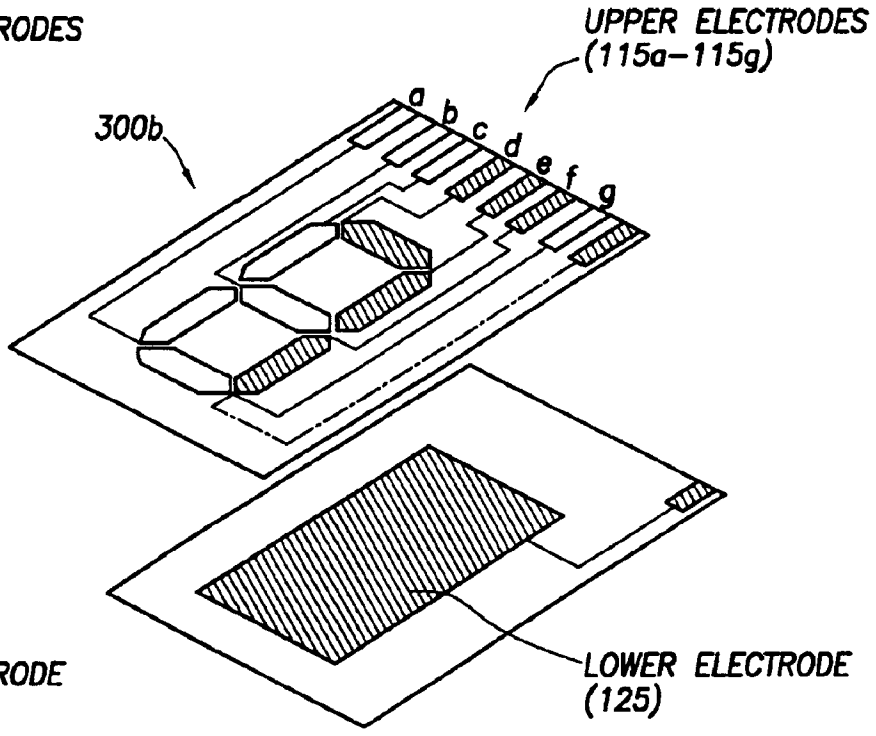
FIG.3B (PRIOR ART)
FIGS. 3A and 3B are exemplary displays of a digit showing electrodes for operating the LCD according to FIG. 1.
Figure 3A:
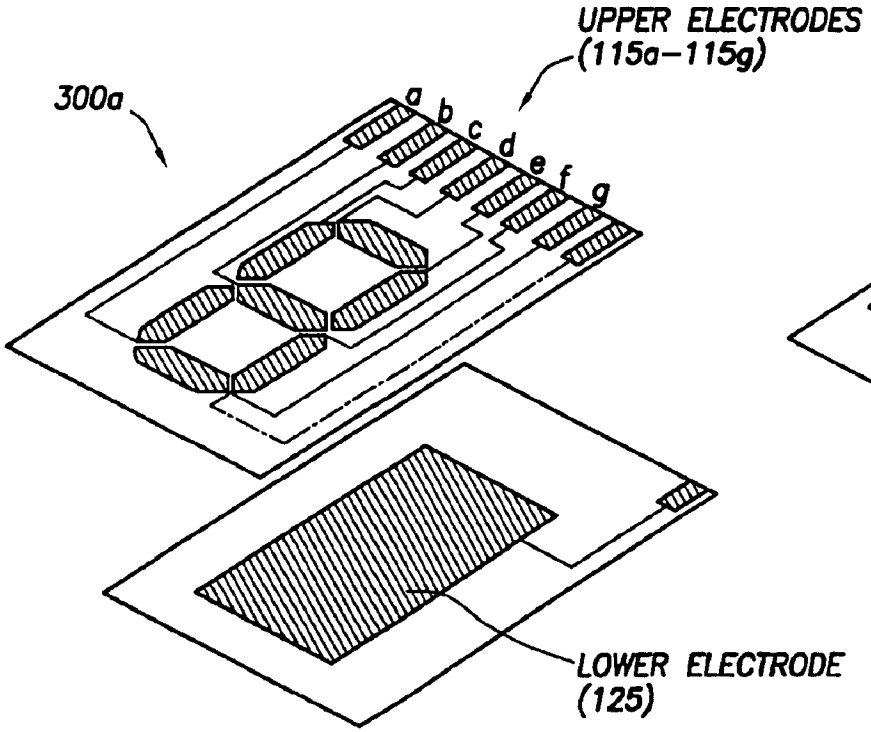
FIG.3A (PRIOR ART)

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Liquid crystal displays (LCD) have become pervasive in every day life as LCDs are incorporated into nearly every device imaginable. Traditionally, LCDs have been used to display information, such as time, date, radio channel, track on a compact disk, etc., to a user of the device. Recent developments of LCDs have provided for more advanced LCDs that are capable of providing multi-level or multi-state displays, including gray-scale and color. As discussed in Brewer et al., U.S. Pat. No. 5,995,456, incorporated herein by reference, various dyes and chemical compositions may be used in LCDs to provide multiple color-level displays.

The Seiko patent, previously discussed, further describes methodologies to produce colored effects in LCDs using inks (e.g., screen print) behind a reflective polarizer. The use of inks behind the reflective polarizer may be combined with various retardation film layers in or on the LCD display to produce a color change from one color (produced by the retardation film) to another color (produced by the screen printed ink). Such a combination provides a designer the ability to design an LCD with multiple color display capability.

While the LCDs have become more advanced, so too have LCD drivers to operate the LCDs. To generate gray-scale and intermediate colors, however, traditional fixed multiplexing drivers that are configured based on the number of backplanes in the LCD are no longer utilized as, once configured, provide for only two levels (i.e., on and off). More advanced drivers using a conventional PWM multiplexing driving approaches to generate intermediate voltage levels to drive the advanced LCDs are too complex and expensive to be utilized in consumer products, such as watches, clocks, garments, ornamental jewelry, and displays. Additionally, such conventional PWM multiplexing driving approaches consume power that is less than desirable for low power or battery operated applications.

The principles of the present invention provide for different driving systems to generate multi-level displays on LCDs using cost effective techniques. There are two general approaches, selectable multiplexing (approach A) and delay signal multiplexing (approach B).

The selectable multiplexing approach (approach A) utilizes multiplexing systems that are commercially available. However, the selectable multiplexing approach does not configure the multiplexing driving system to a fixed multiplexing mode based on the number of backplanes, but rather selectively configures the multiplexing system during operation. Based upon the selected multiplexing mode, a predetermined duty cycle is generated. The predetermined duty cycle generated by the selected multiplexing mode produces an RMS voltage that is applied to the LCD to create an intermediate display level. The intermediate display level may be selectively configured by an external selector, such as a push-button, or by an internal selector, such as a software routine. The simplified generation of intermediate display levels can be fixed or patterned (e.g., ramp or random)

The delay signal multiplexing approach (approach B) for driving an LCD may use a simple processor or other device to generate (i) a substantially periodic signal, and (ii) a delay signal that is time delayed relative to the substantially periodic signal. An RMS voltage is formed on a segment of the LCD to form any of at least three display levels. Similar to the multiplexing approach, the display levels of the LCD may be selectively changed using an external or internal selector. The time delay of the delay signal may include a number of different patterns, including fixed, ramped, and random, for example.

Figure 4A:
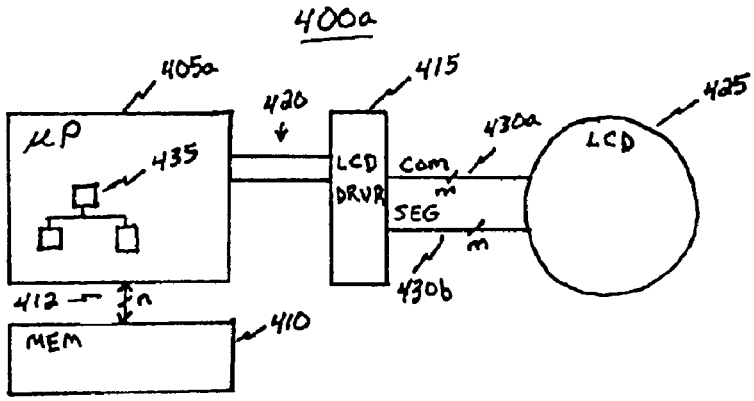
FIGS. 4A and 4B are exemplary configurations of driving systems according to the principles of the present invention.

FIG. 4A is a first embodiment configuration of an LCD driving system 400*a* according to the principles of the present invention. A microprocessor 405*a* is coupled to an external memory 410 via a bus 412. The microprocessor 405*a* is further coupled to an LCD driver 415 via at least one bus 420. The LCD driver 415 is connected to an LCD 425 via two buses, a COM (common) bus 430*a* and a SEG (segment) bus 430*b*. Other bus configurations are also possible. As shown, the LCD 425 is a single segment LCD, but could be a multi-segment LCD as understood in the art. A software program 435 may be executed or operated by the processor 405*a*. The processor 405*a* could be a general or specialized processor, including a digital signal processor (DSP). Further, the LCD driver 415 may be any device as known in the art for driving LCDs.

Figure 4B:
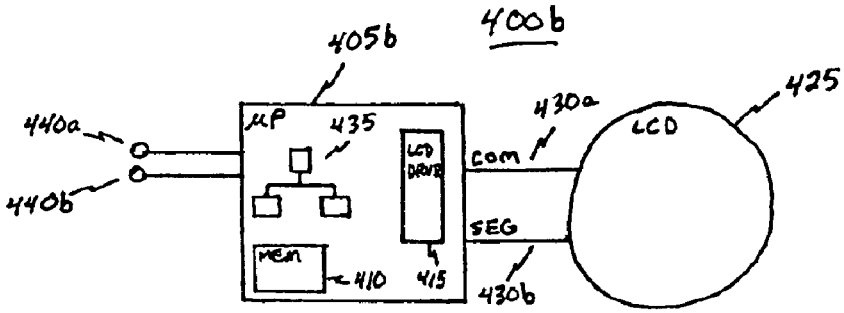

FIG. 4B is a second embodiment configuration of an LCD driving system 400*b* according to the principles of the present invention. In contrast to the LCD driving system 400*a* of FIG. 4A, the memory 410 and the LCD driver 415 are embedded within the processor 405*b*. Also in contrast, the LCD driving system 400*b* includes two selectors 440*a* and 440*b*, which are external from the processor 405*b*. The selectors 440*a* and 440*b* may be push-buttons, dials, knobs, wheels, contact sensors, temperature sensors, or any other type of selector that can alter the state of the computer program 435 or processor 405*b*. Additionally, both LCD driving systems 405*a* and 405*b* can be utilized to maintain time of day.

The configurations of the LCD driving systems 405*a* and 405*b* are capable of driving the LCD 425 utilizing either method A or method B as described with reference to FIGS. 5–8. However, it is contemplated that standardized or generic processors and/or drivers for the LCD may be different for the different methods being utilized to drive the LCD 125. It should be understood that the microprocessors 405*a* and 405*b* could be application specific integrated circuits (ASIC) or other devices having the same or similar functionality, according to the principles of the present invention, for driving an LCD, or segments thereof, to multiple display levels.

In operation, the LCD driving systems 400*a* and 400*b* operate to drive the LCD 425 to multiple display levels, such as grayscale and intermediate colors, automatically, semi-automatically, or manually. The memory may be utilized to store the software program 435. Upon initialization or reset, the processor 405*a* reads the software program 435 from the memory 410 via the bus 412. The processor 405*a* may thereafter execute the software program 435.

The software program 435 may include a plurality of routines for driving the LCD to multiple levels in at least one pattern, including: fixed, ramped, predetermined, random, and pseudo-random. For example, if the LCD 425 is capable of producing blue and yellow at the extreme color ends, then the ramped pattern may transition the voltage levels of the LCD 425 to display a color change from blue to yellow through various shades of green by the software program 435 being executed by the processor 405*a* commanding the LCD driver 415 to change a voltage level being applied to the LCD 425. As shown, the processor 405*a* has no external inputs or selectors for configuring the processor 405*a* (i.e., causing the software program 435 to change states). Therefore, the software program 435 may change states in an automatic manner as programmed. In the case of the LCD 425 being a watch face, the software program 435 may change states in a predetermined manner (e.g., synchronized to time of day), randomly, or pseudo-randomly (e.g., not in synchronization with the time of day).

The LCD driving system 400*b* of FIG. 4B includes two selectors 440*a*–440*b* that may be used to initiate a change of state or mode of the software program 435 manually. For example, an operator may push the selector 440*a* to cause the software program 435 to change the level or color of the LCD 425 in (i) a fixed manner (e.g., blue, green, or yellow), (ii) a predetermined manner (e.g., synchronized to change once per minute or in a predetermined color order), (iii) a ramped manner (e.g., transition from blue to yellow via shades of green), and (iv) a random or pseudo-random manner (e.g., asynchronous with respect to the time of day). Additionally, the selector 440*b* may be utilized to semi-automatically selectively cause the software program 435 to drive the LCD 425 into a predetermined pattern, including either of the extreme levels or colors (e.g., blue and yellow) and any intermediate level (e.g., light-green, medium green, and dark-green) capable of being produced by the LCD driving system 400*b* by the operator initiating a first action via the external selectors 405*a* and 405*b*.

Figure 5:
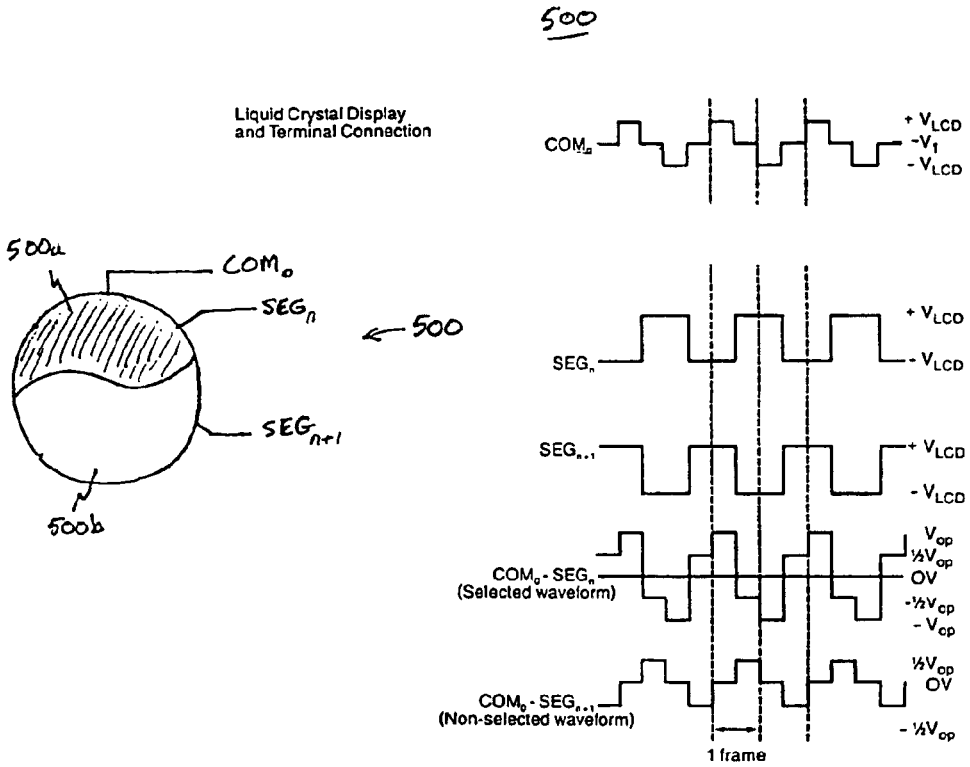
FIG. 5 is a representative LCD display with associated signals as produced by an LCD driving system utilizing selectable multiplexing according to FIGS. 4A and 4B.

FIG. 5 is a representative LCD display 500 with associated signals as may be produced by an LCD driving system utilizing selectable multiplexing approach (approach A) according to FIGS. 4A and 4B. The display 500 shows the connection of the common electrode $COM_0$ as related to the top and bottom segment electrodes $SEG_n$ and $SEG_{n+1}$. As shown, an upper segment is selectively turned on to a selected level by, for example, applying an RMS voltage differential above a turn-on threshold between the $COM_0$ and $SEG_n$ electrodes. A non-selected segment is created by applying an RMS voltage differential between $COM_0$ and $SEG_{n+1}$ electrodes that is below a turn-on threshold.

The configuration of having one common electrode, as shown in FIG. 5, is known as a direct drive configuration, a two common electrode configuration is known as a duplex configuration, a three common electrode configuration is known as a triplex multiplexing configuration, and so on. Standardized LCD driving systems based on multiplexing configurations produce predetermined common and segment driving signals. The voltage levels for the LCD driving system, $V_{on}$ and $V_{off}$, are varied depending on the current multiplex configuration of the LCD driving system.

By selectively configuring the LCD driving system in a particular multiplexing mode during operation, the applied RMS voltage may be set to turn the LCD on, off, or partially on. Although the liquid crystal typically has a preconfigured rotational twist of 90 degrees up to a $V_{off}$ voltage for a given voltage threshold (e.g., 2 Vrms), if an RMS voltage less than 2V, such as 1.8 Vrms, is applied, then the liquid crystal may untwist 75 degrees, for example. By causing an untwist of the liquid crystal less than 90 degrees, an intermediate display level display may be selected. Therefore, by utilizing a fixed multiplexing LCD driving system in such a non-standardized way (i.e., selectable multiplexing), intermediate display levels may be achieved.

Figure 6:
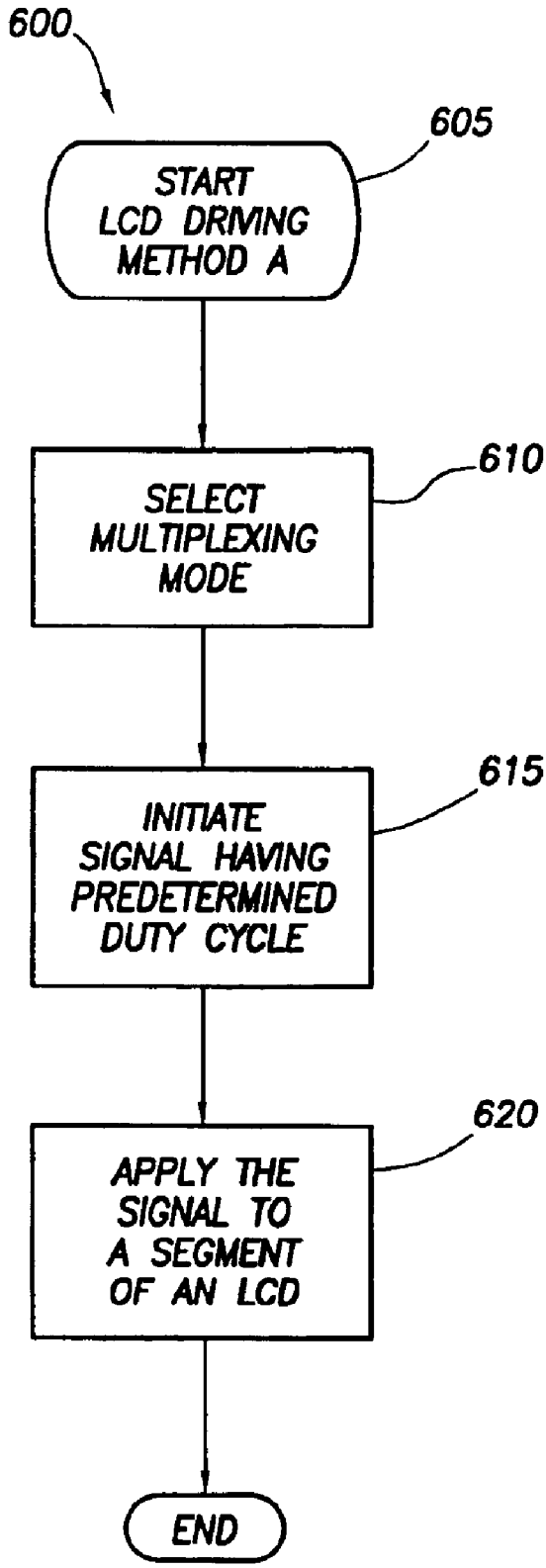
FIG. 6 is an exemplary flow chart describing the operation of the LDC driving system utilizing selectable multiplexing according to FIG. 5.

FIG. 6 is an exemplary flow chart 600 describing the operation of the selectable multiplexing driving system according to FIG. 5. The selectable multiplexing driving system method (method A) starts at step 605. At step 610, a multiplexing mode of at least two different multiplexing modes is selected. The multiplexing mode may be direct drive (i.e., one backplane or common electrode), duplex (i.e., two backplanes), triplex, etc. At step 615, a signal having a predetermined duty cycle based on the selected multiplexing mode is initiated to generate an RMS voltage based upon the selected multiplexing mode. The signal is applied to a segment of an LCD at step 620. It should be understood that the multiplexing mode may be selectively altered during operation to change the voltage level and corresponding color that the LCD is displaying, as discussed in conjunction with FIG. 5. The multiplexing mode may be selectively altered by a variety of mechanisms, including: an internal selector (e.g., software program) and an external selector (e.g., push-button).

Figure 7:
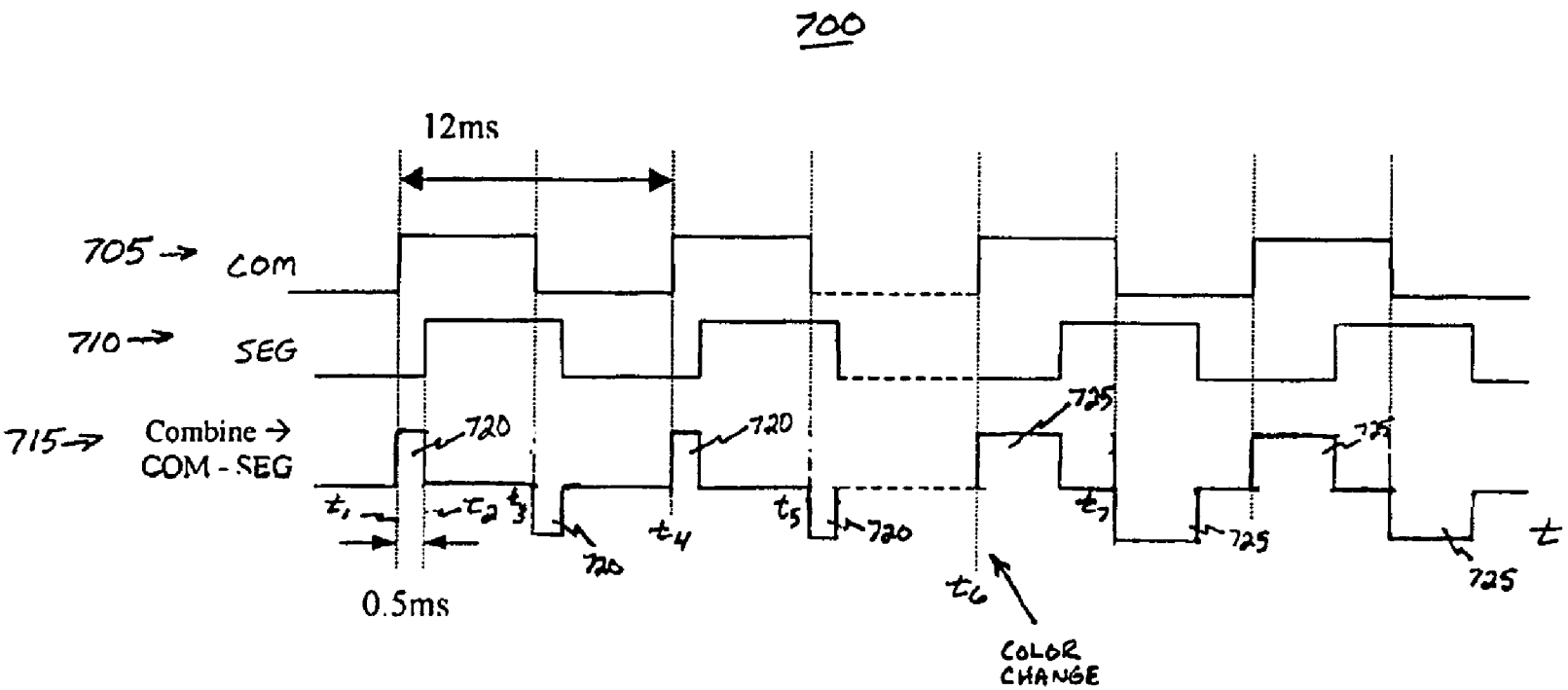
FIG. 7 is a representative signal diagram as produced by a simplified PWM multiplexing driving system according to FIGS. 4A and 4B.

FIG. 7 is a representative signal diagram 700 as produced by a delay signal multiplexing driving system (approach B) according to FIGS. 4A and 4B. A common (COM) signal 705 is substantially periodic having a 12 ms cycle. A segment (SEG) signal 710 similarly may be substantially periodic. The SEG signal 710 may be a derivative of the COM signal 705, where the SEG signal 710 is generated by simply delaying the COM signal, or be an independent signal.

By selectively altering (e.g., phase shifting or time delaying) the SEG signal 710 with respect to the COM signal 705, a resulting RMS voltage may be formed on a segment of the LCD display 425 to produce a display voltage level, which may be an end color (e.g., blue or yellow) or an intermediate color (e.g., green). The COM-SEG signal 715 is representative of the result of the two signals 705 and 710 as applied on the electrodes 430*a* and 430*b* of the LCD 425. As shown, the SEG signal 710 is delayed or phase shifted by $t_2-t_1$ (e.g., 0.5 ms) so that a pulse 720 contains a selected duty cycle of $2*(t_2-t_1)/(t_4-t_1)*100$. The selected duty cycle is maintained through $t_5$.

At $t_6$, the selected duty cycle is altered by delaying the SEG signal 710, which changes the duty cycle of the COM-SEG signal 715 to have a longer pulse 725. The longer pulse 725 raises the RMS voltage applied to the LCD segment, thereby selectively altering the intermediate display level (e.g., color or gray-scale) of the LCD. The time delay may be generated by a software program 435 operating within the processor 425 or an external circuit (not shown) that is either synchronous (e.g., flip-flop) or asynchronous (e.g., inverters).

Figure 8:
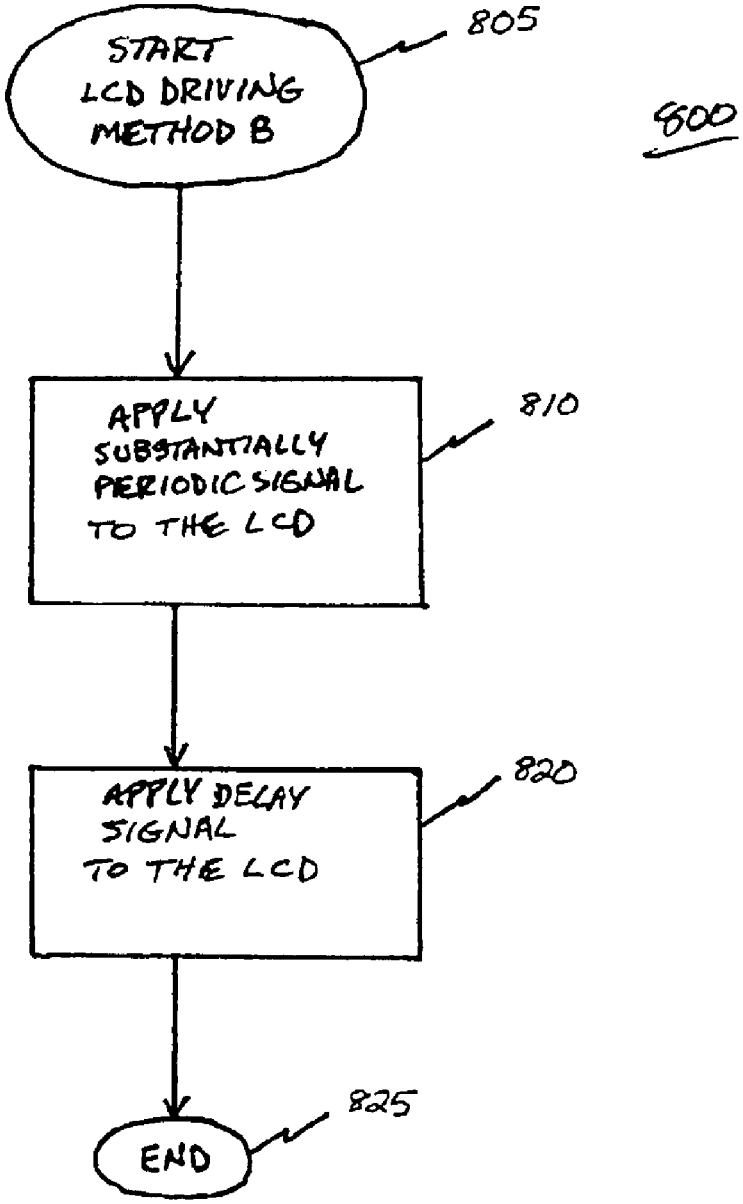
FIG. 8 is an exemplary flow chart describing the operation of the simplified PWM multiplexing driving system according to FIG. 7.

FIG. 8 is an exemplary flow chart 800 describing the operation of the multiplexing driving system according to FIG. 7. At step 805, the delay signal multiplexing driving method (approach B) starts. At step 810, a substantially periodic signal is applied to the LCD. The substantially periodic signal may be applied to either the upper 115 or lower 125 electrode of a segment of the LCD 425, and the resulting differential voltage across the liquid crystal should produce the same effect as understood in the art. At step 820, a delay signal having a time delay is applied to the LCD 425. The time delay of the delay signal 710 is controlled by the LCD driving system 405*a*, for example, that changes the duty cycle (i.e., RMS voltage) applied to the segment of the LCD. The time delay of the delay signal 710 may be selectively altered automatically, semi-automatically, or manually as discussed with reference to FIGS. 4A and 4B. At step 825, the method ends.

Figure 9A:
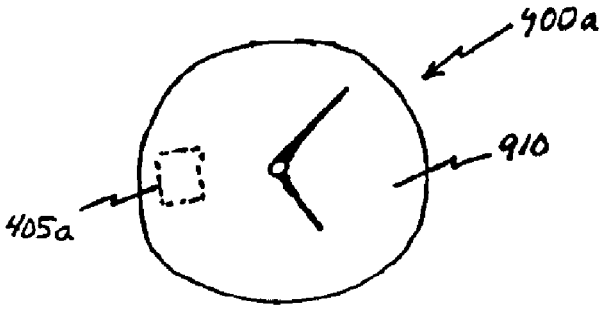
FIGS. 9A, 9B, 10A, 10B, 11A, and 11B are exemplary systems for supporting operation of the LCD driving systems of FIGS. 4A–8.
Figure 9B:
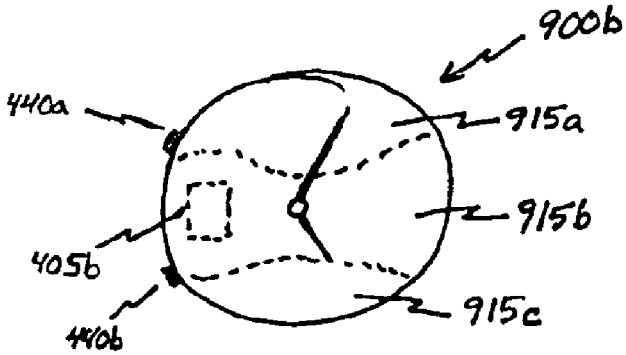

FIGS. 9A and 9B are exemplary systems 900*a* and 900*b* for supporting operation of the LCD driving systems 405*a* and 405*b*, respectively, of FIGS. 4A and 4B. As shown, the systems 900*a* and 900*b* are both timekeeping devices, such as a watch or clock. However, the systems 900*a* and 900*b* may also be a garment, component of a garment, jewelry, display, or any other system that is capable of utilizing the principles of the present invention.

As shown, the system 900*a* includes a single segment LCD 910. As a single segment LCD 910, there exists one common and one segment electrode (not specifically shown). The single segment LCD 910 is, in fact, the entire display dial of the timekeeping device 900*a*, and can have the level of the LCD selectively altered to any level established by the selection of the LCD. For example, if the LCD is a color selectable LCD, then the display dial can be selectively set to one of the extreme colors or an intermediate color between the extreme colors. As the LCD driving system 405*a* utilizes an internal selector (not shown) to select the level (s) of the LCD 910, the level of the LCD 910 may be automatically selected, either time-synchronously or asynchronously. Any pattern (e.g., ramp) for changing the level of the LCD 910 may be preprogrammed.

FIG. 9B includes a multi-segment LCD 915*a*, 915*b*, 915*c* (collectively 915), where each segment may include separate common and segment electrodes. Alternatively, a common electrode corresponding to each segment electrode may be utilized to establish the multi-segment LCD 915. By utilizing a multi-segment LCD 915, each segment may selectively display a different level so as to produce different effects for the viewer of the display. Two external selectors 440*a* and 440*b* may be included on the timekeeping device 900*b* to allow the operator to manually or semi-automatically alter the display. For example, the operator may push the external selector 440*a* to select fixed levels for each segment of the display. Alternatively, the operator may push the external selector 440*b* to selectively configure the LCD driving system 405*b* to operate in an automatic mode, where the levels of the individual segments 915*a*, 915*b*, and 915*c* of the multi-segment LCD 915 are altered, synchronously, asynchronously, time dependent, or not time dependent. It should be understood that either approach A or B for driving the LCD display 915 could be applied to systems 900*a* and 900*b*.

Figure 10A:
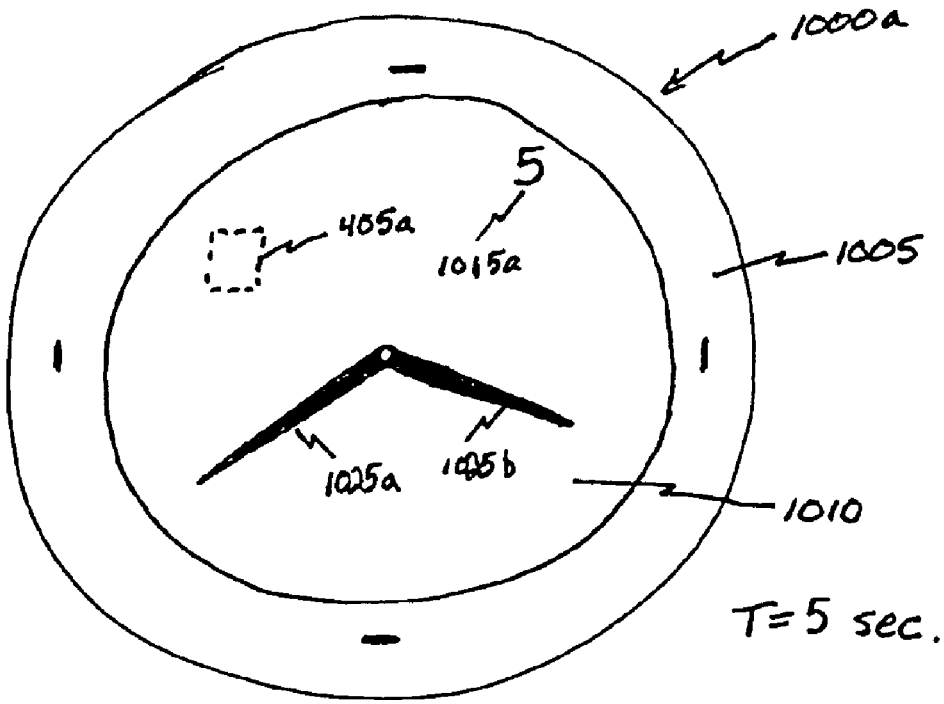
Figure 10B:
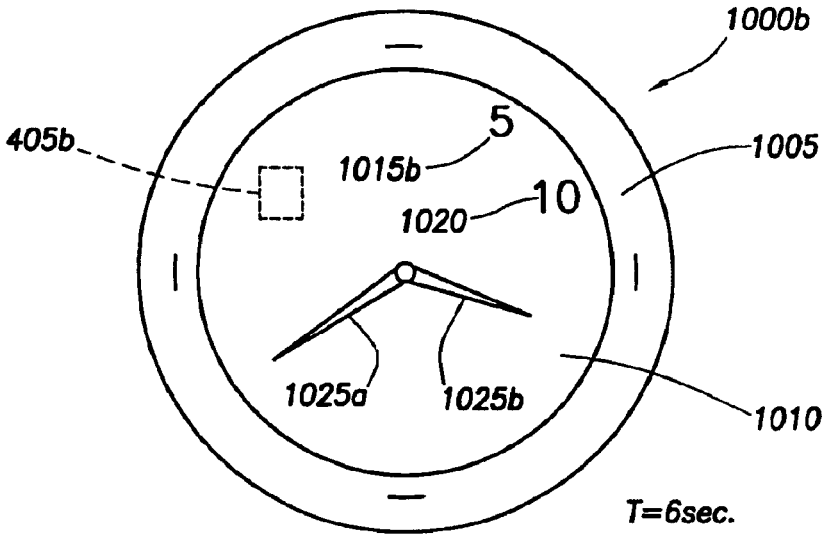

FIGS. 10A and 10B are additional exemplary systems 1000*a* and 1000*b* for supporting operation of the LCD driving systems 405*a* and 405*b* of FIGS. 4A and 4B. Similar to FIGS. 9A and 9B, the systems 1000*a* and 1000*b* are both timekeeping devices, such as a watch or clock.

The system 1000*a* includes an outer ring 1005 and an LCD display 1010. The (LCD display is 1010 capable of displaying a primary color, such as red, and a secondary color, such as yellow. Alternatively, a gray scale or reflective display could be utilized. If the LCD display 1010 has a primary color of red, then to display a time element, an LCD segment may be selectively enabled to display time representative numbers, such as time in seconds, in a secondary color of yellow or an intermediate color, such as orange. For example, the number "5" 1015*a* is composed of a segment of the LCD 1010. As indicated, the time in seconds is "5" seconds, which is why no other numbers around the dial, such as "10", "15", "20", etc., are displayed.

In FIG. 10B, the time in seconds is equal to six seconds. As such, the number "5" 1015*b* begins to change from the secondary color (i.e., yellow) back to the primary color (i.e., red) of the LCD 1010, and the number "10" 1020 begins to turn yellow. Because six seconds is 20 percent beyond five seconds, the "5" 1015*b* is approximately 80% enabled (i.e., 80% red and 20% yellow) and the number "10" is approximately 20% enabled (i.e., 20% red and 80% yellow). Other enabling and disabling techniques or synchronizations may alternatively be utilized. It should be understood that the colors of the LCD 1010 may be varied, but that the numbers representing seconds, minutes, and/or hours being transitioned on and off through intermediate levels by utilizing the principles of the present invention are the same.

Alternatively, rather than utilizing numbers (e.g., "5" 1015*a*), symbols, such as a circle or some other indication, could be placed at positions representing a particular time period (e.g., seconds of a 60 second period) by placing segments of the LCD display 1010 at those locations. Yet another embodiment could have minute 1025*a* and hour 1025*b* hands being formed by segments of the LCD display 1010 being driven by the LCD driving system 405*a* or a second LCD driving system dedicated to the minute 1015*a* and hour 1015*b* hands. While a traditional analog timekeeping device 1000*a* is shown, a digital timekeeping device may similarly utilize the principles of the present invention.

Figure 11A:
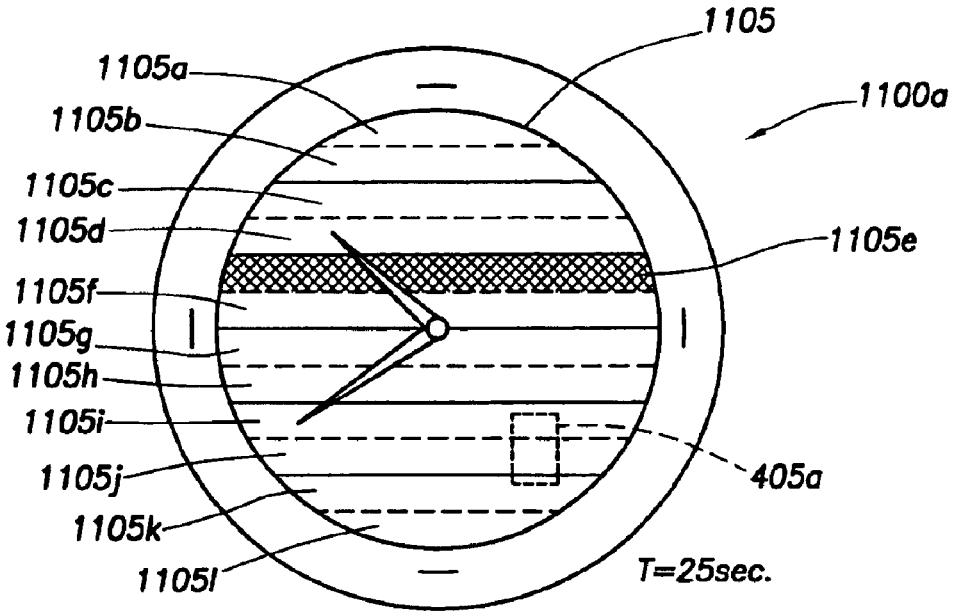
Figure 11B:
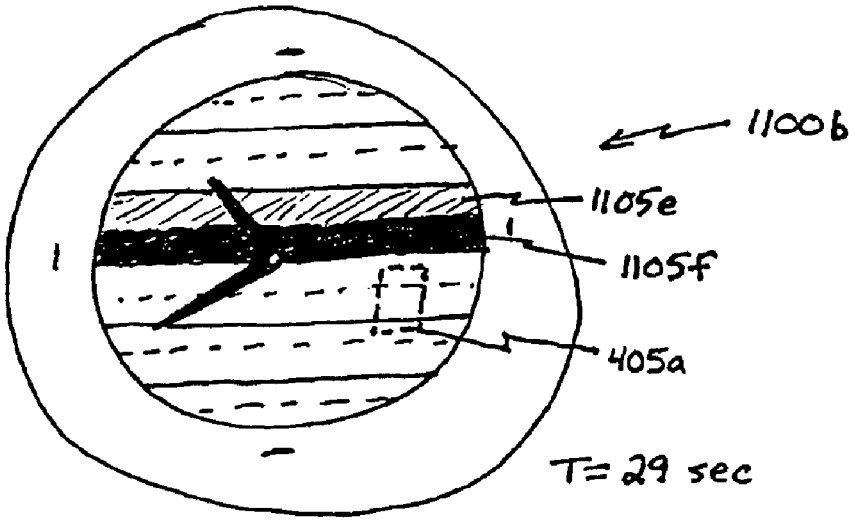

FIGS. 11A and 11B include yet another embodiment of systems 1100*a* and 14100*b* for supporting operation of the LCD driving system 405*a*. As shown, the systems 1100*a* and 1100*b* are both timekeeping devices. The LCD 1105 includes twelve segments 1105*a*–11051. Between every other segment, a solid line is shown on the LCD 1105 to indicate to an operator or user of the timekeeping device 1100*a* the approximate time in seconds. The dashed lines are invisible to the operator.

To illustrate operation of the timekeeping device 1100*a*, a fifth segment 1105*e* is completely highlighted (i.e., colored or darkened depending upon the LCD type), which indicates that time in seconds equals 25 seconds of a 60 second cycle. In FIG. 11B, the time is equal to 29 seconds, and, expectedly, segment 1105*e* is 20% highlighted and segment 1105*f* is 80% highlighted. It should be understood that the LCD driving system 405*a* drives each of the segments of the LCD 105 utilizing the principles of the present invention to transition the segments 1105*a*–1105*l* through intermediate display levels in a time dependent manner. It should be further understood that the segments 1105*a*–1105*l* could be driven in a non-time dependent manner.

The previous description is of a preferred embodiment for implementing the invention, and the scope of the invention should not necessarily be limited by this description. The scope of the present invention is instead defined by the following claims.

What is claimed is:

1. A system for driving a liquid crystal display (LCD) having a segment including a first and second electrode, the system comprising:

an LCD driver coupled to the first and second electrodes of the segment of the LCD;

a processor coupled to the LCD driver, the processor initiating a substantially periodic signal on the first electrode and a delay signal on the second electrode, the delay signal having a time delay relative to the substantially periodic signal, the signals on the first and second electrodes forming an RMS voltage to drive the segment of the LCD to any of at least three display levels; and a selector means for selectively changing the time delay of the delay signal.

2. The system according to claim 1, wherein the delay signal includes at least one of the following delays: negative, positive, and zero.

3. The system according to claim 1, wherein the delay signal is substantially periodic.

4. The system according to claim 2, wherein the delay signal is formed from at least one of the following:

a software program operating within said processor; and a circuit external from said processor.

5. The system according to claim 1, wherein said selector means comprises an external selector connected to said processor.

6. The system according to claim 5, wherein said external selector is at least one of the following: a pushbutton, a dial, a knob, a wheel, a contact sensor, and a temperature sensor.

7. The system according to claim 5, wherein said external selector selectively configures the processor such that the time delay of the delay signal changes.

8. The system according to claim 1, wherein said selector means comprises an internal selector operating within said processor for selectively changing the time delay of the delay signal.

9. The system according to claim 8, wherein the internal selector selects a time delay in at least one of the following patterns: fixed, ramped, predetermined, random, and pseudo-random.

10. The system according to claim 1, wherein the system further maintains time-of-day.

11. The system according to claim 1, wherein the system is included within at least one of the following: a clock, a watch, a garment, a component of a garment, jewelry, and display.

12. The system according to claim 1, wherein the LCD is a reflective LCD.

13. The system according to claim 1, wherein the LCD includes at least one of the following: a gray scale LCD, a color selectable LCD, and a reflective LCD.

14. The system according to claim 1, wherein said driver and said processor are contained within a single integrated circuit package.

15. A method for driving a liquid crystal display (LCD) having a segment including a first and a second electrode, the method comprising:

applying a substantially periodic signal to the first electrode; and applying a delay signal to the second electrode, the delay signal having a selectively changeable time delay relative to the substantially periodic signal, the signals on the first and second electrodes forming an RMS voltage to drive the segment of the LCD to any of at least three display levels.

16. The method according to claim 15, wherein the delay signal includes at least one of the following delays: positive, zero, and negative.

17. The method according to claim 15, wherein the delay signal is substantially periodic.

18. The method according to claim 15, wherein the time delay is manually selected.

19. The method according to claim 15, wherein the time delay is automatically selected.

20. The method according to claim 19, wherein selecting the delay signal includes at least one of the following patterns: fixed, ramped, predetermined, random, and pseudo-random.

21. The method according to claim 15, further comprising maintaining time-of-day.

22. The method according to claim 15, wherein the method is performed within at least one of the following: a clock, a watch, a garment, a component of a garment, jewelry, and display.

23. The method according to claim 15, wherein the LCD is a reflective LCD.

24. The method according to claim 15, wherein the LCD includes at least one of the following: a gray scale LCD, a color selectable LCD, and a reflective LCD.

25. A computer-readable medium having stored thereon sequences of instructions, the sequences of instructions including instructions, when executed by a processor, causes the processor to perform:

forming a substantially periodic signal on a first electrode of a segment of an LCD;

forming a delay signal on a second electrode of the segment, the delay signal having a selectively changeable time delay relative to the substantially periodic signal; and driving the substantially periodic signal and the delay signal to the segment of the LCD to display any of at least three display levels.

26. The computer-readable medium of claim 25, wherein the computer-readable medium operates within at least one of the following: a clock, a watch, a garment, a component of a garment, jewelry, and display.

27. A system for driving a liquid crystal display (LCD) having a segment including a first and second electrode, the system comprising:

means for driving the segment of the LCD;

means for initiating a substantially periodic signal on the first electrode and a delay signal on the second electrode, the delay signal having a time relay relative to the substantially periodic signal, the signals on the first and second electrodes forming an RMS voltage to drive the segment of the LCD to any of at least three display levels; and means for selectively changing the time delay of the delay signal.

* * * * *

UNITED STATES PATENT AND TRADEMARK OFFICE

CERTIFICATE OF CORRECTION

PATENT NO. : 6,937,212 B2
APPLICATION NO. : 10/199611
DATED : August 30, 2005
INVENTOR(S) : Donald R. Brewer and Lee Tak Chun It is certified that error appears in the above-identified patent and that said Letters Patent is hereby corrected as shown below:

Column 10, line 38, after "selector is at least one of the following:", delete [a pushbutton], and add --a push-button--

Column 11, line 7, after "LCD", add --display--

Column 11, line 10, "signal includes at least one of the following delays:", should be corrected to read "signal includes at least one of the following displays:"

Signed and Sealed this

Twenty-second Day of August, 2006

JON W. DUDAS
*Director of the United States Patent and Trademark Office*